US007794047B2

(12) United States Patent
Drake et al.

(10) Patent No.: US 7,794,047 B2
(45) Date of Patent: Sep. 14, 2010

(54) EFFICIENT IMAGE ARRAY MICRO ELECTROMECHANICAL SYSTEM (MEMS)JET

(75) Inventors: Donald Drake, Rochester, NY (US); Peter Nystrom, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 594 days.

(21) Appl. No.: 11/842,613

(22) Filed: Aug. 21, 2007

(65) Prior Publication Data

US 2009/0051733 A1 Feb. 26, 2009

(51) Int. Cl.
*B41J 2/145* (2006.01)
*B41J 2/15* (2006.01)

(52) U.S. Cl. ..... 347/40; 347/58

(58) Field of Classification Search ..... 347/40, 347/42, 49–50, 58
See application file for complete search history.

(56) References Cited

U.S. PATENT DOCUMENTS 7,699,437 B2 * 4/2010 Choi et al. ..... 347/42
2006/0170732 A1 * 8/2006 Yamada ..... 347/49

* cited by examiner

*Primary Examiner*—Thinh H Nguyen
(74) *Attorney, Agent, or Firm*—MH2 Techology Law Group LLP

(57) ABSTRACT

An imaging array and method of forming an imaging array includes a plurality of staggered imaging dies formed as a row of alternating open spaces and imaging dies. A plurality of driver dies can be adaptively arranged in the open spaces formed by the staggered imaging dies. The use of the open spaces between the staggered imaging dies allows for a color imaging array that occupies a waterfront of approximately 20 mm.

18 Claims, 3 Drawing Sheets

EFFICIENT IMAGE ARRAY MICRO ELECTROMECHANICAL SYSTEM (MEMS)JET

FIELD

The subject matter of the teachings disclosed herein relates to print heads. More particularly, the subject matter of the teachings disclosed herein relates to an imaging array.

BACKGROUND

One of the difficult constraints associated with an imaging array is to provide a reasonable nozzle density while minimizing the print head in the drum motion direction, called waterfront. The reason for this constraint is that the curvature of the drum on which the drops are printed creates different flight distances and arrival times for the drops from different nozzle arrays in a four color print head. Unless the nozzle arrays are close together, the resulting image will have defects. Exacerbating this issue is the fact that most printing arrays composed of subunits choose to stagger the subunits to avoid the difficult issues entailed in tightly butting the subunits. While the staggered architecture avoids the butting issues, it exacerbates the issue of waterfront, since the depth of the imaging array must now be at least twice the depth of a single die.

FIG. 1 shows a conventional, single color staggered imaging array 100. In particular, a conventional staggered imaging array 100 relying on micro electromechanical system (MEMS) technology includes staggered MEMS dies 110*a*-110*d* and associated driver dies 120*a-d*.

Driver die 120*a* provides driver functionality for MEMS die 110*a*. Driver die 120*b* provides driver functionality for MEMS die 110*b*. Driver die 120*c* provides driver functionality for MEMS die 110*c*. Driver die 120*d* provides driver functionality for MEMS die 110*d*.

MEMS dies 110*a* and 110*b* are slightly staggered with respect to one another to double the resolution as compared to use of an individual MEMS die 110*b*. For example, if the nozzle resolution of die 110*a* is 150 nozzles per inch, the resolution of the slightly staggered pair 110*a* and 110*b* is 300 nozzles per inch. MEMS dies 110*c* and 110*d* are slightly staggered with respect to one another to double the resolution as compared to use of an individual MEMS die 110*c*. MEMS die 110*a* and 110*b* can easily be combined into a single die with a fill slot in between the two arrays; likewise for die 110*c* and 110*d*. In any case, it is desirable for die 110*a* and 110*b* to be staggered relative to die 110*c* and 110*d* to avoid the difficult butting issues of trying to precisely and tightly butt die 110*a* and 110*b* with die 110*c* and 110*d*.

It would be desirable that the waterfront of the conventional staggered imaging array 100 is minimized, ideally no greater than the depth of the MEMS die 110*a*+110*b*+110*c*+110*d*=10 mm in this example. However, because the driver dies 120*a* and 120*d* must be arranged next to their respective MEMS dies 110*a* and 110*d* the resultant full depth of the conventional staggered imaging array from top to bottom is approximately 15 mm because it must include the added depth of the two driver die. In this example, the depth of the staggered imaging array is 15 mm, even though the depth of the MEMS die is only 10 mm. With space constraints (waterfront) inside of a printer device utilizing an imaging array 100 becoming increasingly more limited, a 15 mm depth for each conventional imaging array 100 can become a relevant design constraint.

Accordingly, the present teachings solve these and other problems of the prior art's depth of an imaging array.

SUMMARY

In accordance with the teachings, an imaging array is disclosed herein. The imaging array includes a plurality of staggered imaging dies to form a row of alternating open spaces and imaging dies, and a plurality of driver dies adaptively arranged in the open spaces formed by the staggered imaging dies.

In accordance with the teachings, a method of forming an imaging array is disclosed herein. The method of forming an imaging array includes staggering a plurality of imaging dies to form a row of alternating open spaces and imaging dies, and adaptively arranging a plurality of driver dies in the open spaces formed by the staggered imaging dies.

Additional advantages of the embodiments will be set forth in part in the description which follows, and in part will be obvious from the description, or may be learned by practice of the teachings. The advantages will be realized and attained by means of the elements and combinations particularly pointed out in the appended claims.

It is to be understood that both the foregoing general description and the following detailed description are exemplary and explanatory only and are not restrictive of the teachings, as claimed.

The accompanying drawings, which are incorporated in and constitute a part of this specification, illustrate embodiments of the teachings and together with the description, serve to explain the principles of the teachings.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the teachings disclosed herein are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5.

In accordance with the teachings disclosed herein, an imaging array architecture is disclosed that can provide for an efficient packing of a Micro ElectroMechanical System (MEMS)JET print die and driver die pair. Using a staggered arrangement of MEMS print dies for a staggered imaging array, an open space is created between the MEMS print dies.

A driver chip is arranged in this open space without increasing the waterfront of the imaging array. An imaging array packaged in accordance with the principles disclosed herein can meet the stringent requirements of a printer architecture to pack four color arrays in the minimum waterfront.

Figure 2:
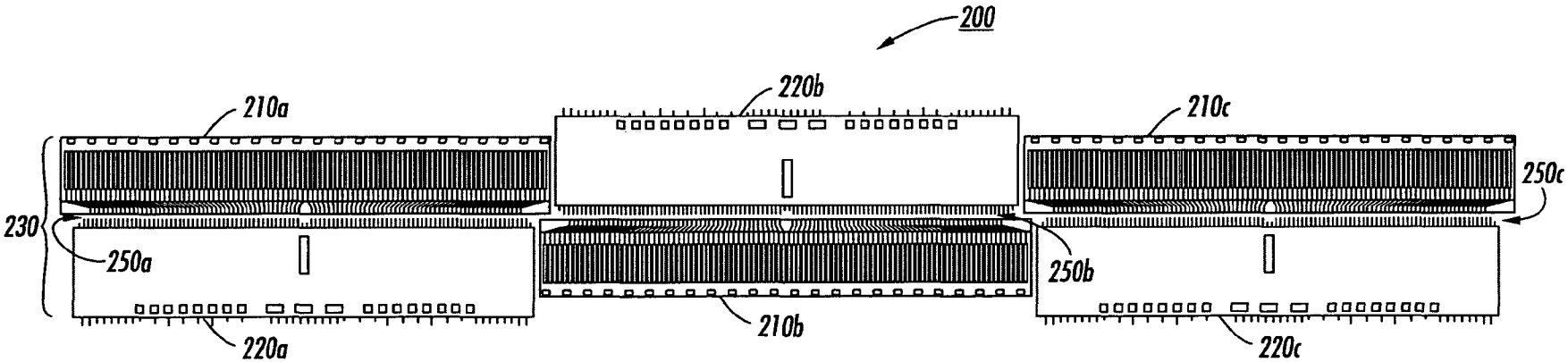
FIG. 2 shows a portion of a staggered imaging array, in accordance with the principles of the present teachings.

FIG. 2 shows a portion of a staggered imaging array 200, in accordance with the principles of the present teachings. It should be readily apparent to those of ordinary skill in the art that the staggered imaging array 200 shown in FIG. 2 represents a generalized system illustration and that other components can be added or existing components can be removed or modified while still remaining within the spirit and scope of the present teachings.

In particular, FIG. 2 shows a portion of a staggered imaging array 200 that can include MEMS dies 210*a-c* electrically coupled to respective driver dies 220*a-c*. Only a portion of the imaging array 200 is shown for simplification purposes only, with one of ordinary skill in the art understanding that the teachings disclosed herein applying to an imaging array of any width. Driver die 220*a* provides driver functionality for MEMS die 210*a*, driver die 220*b* provides driver functionality for MEMS die 210*b*, and driver die 220*c* provides driver functionality for MEMS die 210*c*.

Every other MEMS dies 210*a* and 210*c* along the top row of the staggered imaging array 200 is arranged with its electrical contacts on their respective bottom edge 250*a* and 250*c*. Likewise MEMS die 210*b* along the bottom row of the staggered imaging array 200 is arranged with its electrical contacts on its top edge 250*b*. Every other driver dies 220*a* and 220*c* along the bottom row of the staggered imaging array 200 can be arranged with its electrical contacts on their top edge 250*a* and 250*c*. Likewise driver die 220*b* along the top row of the staggered imaging array 200 can be arranged with its electrical contacts on its bottom edge 250*b*.

The MEMS dies 210*a* and 210*c* can overlap by a small margin with MEMS die 210*b* in a staggered imaging array 200, as shown in FIG. 2. Because of this small overlap, the open spaces formed between MEMS dies 220*a-c* can be smaller in width than any individual MEMS die 210*a-c*. To allow the driver dies 220*a-c* to be mounted in the open spaces created in a staggered imaging array 100, the driver dies 220*a-c* can be smaller in width than an individual MEMS die 210*a-c*. The driver dies 220*a-c* can be any width that allows for their arrangement in the open spaces 120*a-c*.

Thus, in accordance with the principles disclosed herein, driver dies 220*a-c* can be arranged in open areas created in a staggered arrangement for MEMS dies 220*a-c*. The waterfront created with the staggered imaging array 200 using alternating MEMS dies and driver dies in a horizontal axis can create a waterfront of approximately 5 mm. The staggered imaging array 200 can be used as a building block for forming an imaging array that includes higher resolutions and/or an imaging array that includes multiple colors.

Figure 3:
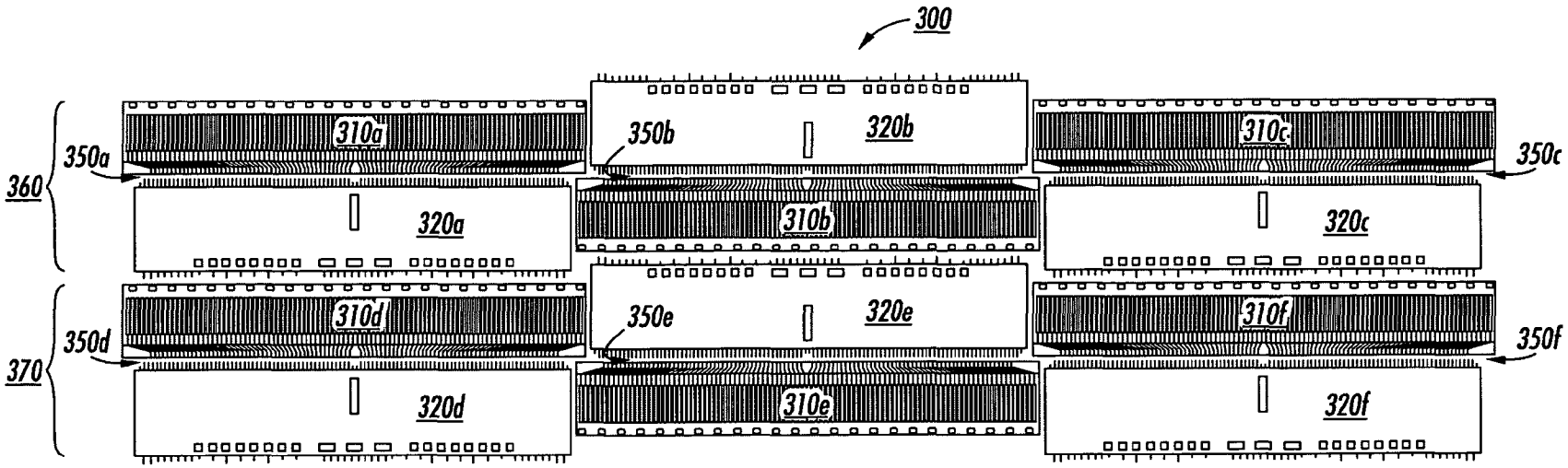
FIG. 3 shows a portion of a staggered imaging array, in accordance with the principles of the present teachings.

FIG. 3 shows a portion of a staggered imaging array 30, in accordance with the principles of the present teachings. It should be readily apparent to those of ordinary skill in the art that the imaging array 300 shown in FIG. 3 represents a generalized system illustration and that other components can be added or existing components can be removed or modified while still remaining within the spirit and scope of the present teachings.

In particular, FIG. 3 shows a portion of a staggered imaging array 300 that can include MEMS dies 310*a-f* electrically coupled to respective driver dies 320*a-f*. Only a portion of the imaging array 300 is shown for simplification purposes only, with one of ordinary skill in the art understanding that the teachings disclosed herein applying to an imaging array of any width. Staggered imaging array 300 can include upper MEMS dies 310*a-c* and driver dies 320*a-c* pairs 360 and lower MEMS dies 310*d-f* and driver dies 320*d-f* pairs 370. Driver die 320*a* provides driver functionality for MEMS die 310*a*, driver die 320*b* provides driver functionality for MEMS die 310*b*, driver die 320*c* provides driver functionality for MEMS die 310*c*, driver die 320*d* provides driver functionality for MEMS die 310*d*, etc.

Every other MEMS die 310*a* and 310*c*, along the top row of the upper MEMS dies 310*a-c* and driver dies 320*a-c* pairs 360 can be arranged with its electrical contacts on their respective bottom edge 350*a* and 350*c*. Likewise, MEMS die 310*b* along the bottom row of the upper MEMS dies 310*a-c* and driver dies 320*a-c* pairs 360 can be arranged with its electrical contacts on its top edge 350*b*. Every other driver die 320*a* and 320*c* along the bottom row of the upper MEMS dies 310*a-c* and driver dies 320*a-c* pairs 360 can be arranged with its electrical contacts on their respective top edges 350*a* and 350*c*. Likewise driver die 320*b* along the top row of the upper MEMS dies 310*a-c* and driver dies 320*a-c* pairs 360 can be arranged with its electrical contacts on its bottom edge 350*b*.

Every other MEMS die 310*d* and 310*f*, along the top row of the lower MEMS dies 310*d-f* and driver dies 320*d-f* pairs 370 can be arranged with its electrical contacts on their respective bottom edge 350*d* and 350*f*. Likewise, MEMS die 310*e* along the bottom row of the lower MEMS dies 310*d-e* and driver dies 320*d-f* pairs 370 can be arranged with its electrical contacts on its top edge 350*e*. Every other driver die, 320*d* and 320*f* along the bottom row of the lower MEMS dies 310*d-f* and driver dies 320*d-f* pairs 370 can be arranged with its electrical contacts on their respective top edges 350*d* and 350*f*. Likewise driver die 320*e* along the top row of the lower MEMS dies 310*d-f* and driver dies 320*d-f* pairs 370 can be arranged with its electrical contacts on its bottom edge 350*e*.

Figure 1:
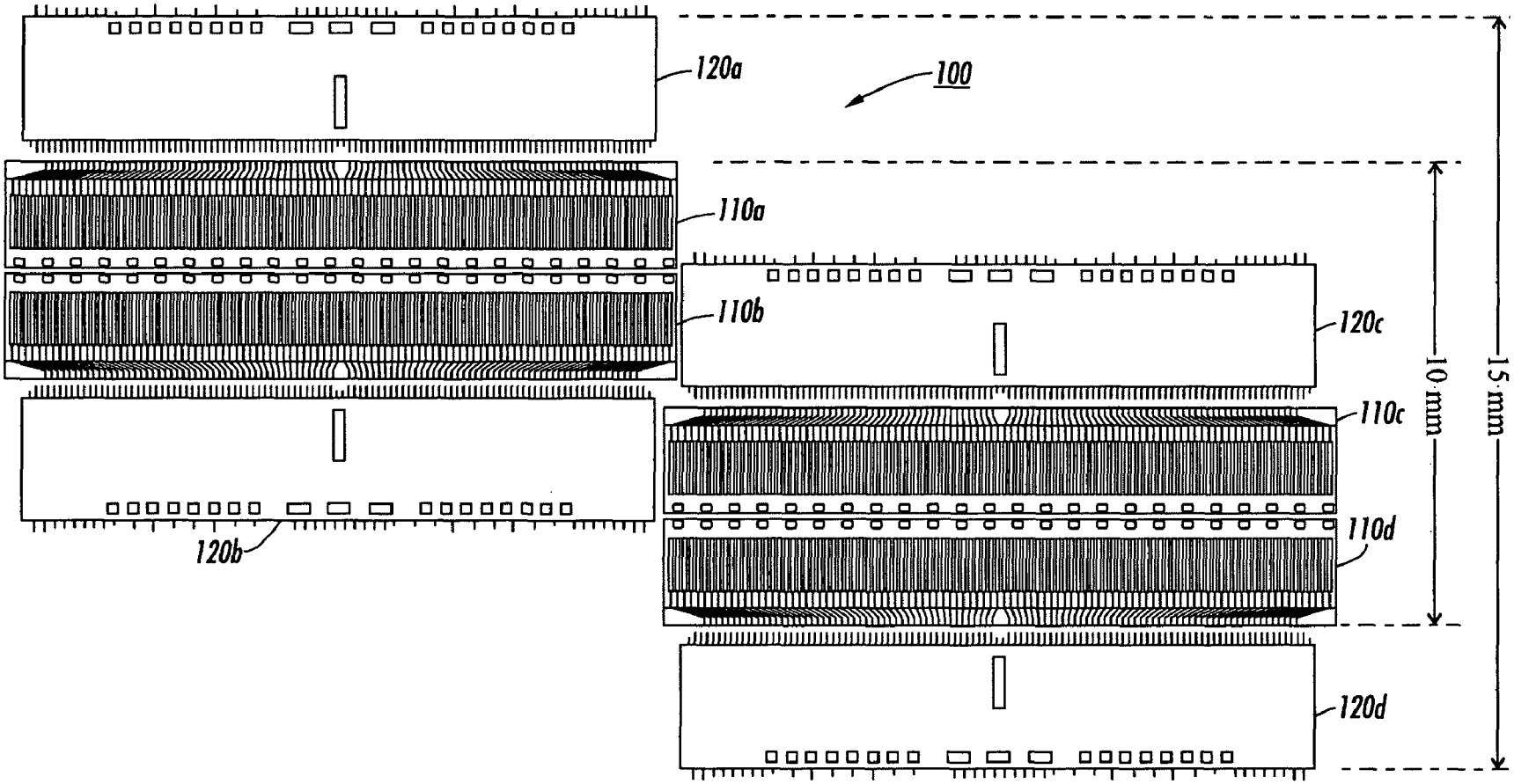
FIG. 1 shows a conventional staggered imaging array.

Thus, In accordance with the principles disclosed herein driver dies 320*a-f* are arranged in the open areas created in the staggered layout of MEMS dies 410*a-f*. The waterfront created with the staggered imaging array 200 using alternating MEMS dies and driver dies along a horizontal axis can create a waterfront of approximately 10 mm. When comparing the conventional arrangement shown in FIG. 3 with the exemplary embodiment depicted in FIG. 1, both have equivalent nozzle resolution. However, the architecture of the exemplary embodiment depicted in FIG. 1 consumes 15 mm of depth while the conventional arrangement shown in FIG. 3 only consumes 10 mm of depth so the architecture of the exemplary embodiment depicted in FIG. 3 is significantly more efficient in waterfront. The architecture of the exemplary embodiment depicted in FIG. 3 achieves the desired objective of minimizing the waterfront to just the combined depth of the staggered MEMS die; that is, there is no depth penalty for the driver die.

The staggered imaging array disclosed herein (with separate driver die) uses no more waterfront than a staggered imaging array that relies on MEMS dies with integrated driver electronics. Moreover, the decoupling of the driver dies from the MEMS dies decouples their respective yields. An exemplary yield for individual MEMS dies can be 70%, i.e., 30% of MEMS dies manufactured are defective and not suitable for inclusion into a printing device. An exemplary yield for individual driver dies can be 70%, i.e., 30% of driver dies manufactured are defective and not suitable for inclusion into a printing device. The resultant yield for an integrated solution would be the product of the two yields, i.e., 49% of integrated MEMS die/driver die combination would be suitable for inclusion into a printing device. The teachings disclosed herein produce higher yields than an integrated MEMS die/driver die solution.

Although the teachings disclosed herein exemplarily illustrate a staggered imaging array that relies on MEMS technology, one of ordinary skill in the art would recognize that the teachings disclosed herein can apply to a staggered imaging array that relies on any imaging technology. For example, the individual imaging dies can be a piezo-electric imaging die, light emitting diode (LED) imaging die, thermal imaging die, etc.

The imaging arrays 200 and 300 disclosed herein can be use for any width imaging array. The imaging arrays 200 and 300 can be less than a width of an imaging medium, e.g., a width of a paper. The imaging arrays 200 and 300 can be used to form a full width imaging array to print an entire width of an imaging medium at a time.

While the teachings disclosed herein have been illustrated with respect to one or more implementations, alterations and/or modifications can be made to the illustrated examples without departing from the spirit and scope of the appended claims. In addition, while a particular feature of the teachings disclosed herein may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising."

Other embodiments of the teachings disclosed herein will be apparent to those skilled in the art from consideration of the specification and practice of the teachings disclosed herein. It is intended that the specification and examples be considered as exemplary only, with a true scope and spirit of the teachings disclosed herein being indicated by the following claims.

What is claimed is:

1. An imaging array, comprising:

a plurality of staggered imaging dies to form a row of alternating open spaces and imaging dies; and a plurality of driver dies adaptively arranged in the open spaces formed by the staggered imaging dies.

2. The imaging array according to claim 1, further comprising a second row of staggered imaging dies.

3. The imaging array according to claim 1, wherein a width of an individual driver die from the plurality of driver dies is less than a width of an individual imaging die from the plurality of imaging dies.

4. The imaging array according to claim 1, wherein the imaging dies are color imaging dies.

5. The imaging array according to claim 4, wherein a waterfront of the plurality of color imaging dies and the plurality of driver dies is approximately 20 mm.

6. The imaging array according to claim 1, wherein the plurality of imaging dies are micro-mechanical system (MEMS) imaging dies.

7. The imaging array according to claim 1, wherein the imaging dies are piezo-electric imaging dies.

8. The imaging array according to claim 1, further comprising a circuit board to provide a mounting surface for the plurality of imaging dies and the plurality of driver dies.

9. The imaging array according to claim 1, wherein a waterfront of the plurality of imaging dies and the plurality of driver dies is approximately 5 mm.

10. A method of forming an imaging array, comprising:

staggering a plurality of imaging dies to form a row of alternating open spaces and imaging dies; and adaptively arranging a plurality of driver dies in the open spaces formed by the staggered imaging dies.

11. The method of forming an imaging array according to claim 10, further comprising forming a second row of staggered imaging dies.

12. The method of forming an imaging array according to claim 10, further comprising forming a color imaging array from the plurality of imaging dies.

13. The method of forming an imaging array according to claim 12, further comprising forming the color imaging array in a waterfront of approximately 20 mm.

14. The method of forming an imaging array according to claim 10, wherein the plurality of imaging dies are micro-electromechanical system (MEMS) imaging dies.

15. The method of forming an imaging array according to claim 10, wherein the imaging dies are piezo-electic imaging dies.

16. The method of forming an imaging array according to claim 10, further comprising providing a circuit board, the circuit board providing a mounting surface for the plurality of imaging dies and the plurality of driver dies.

17. The method of forming an imaging array according to claim 10, further comprising forming the imaging array in a waterfront of approximately 5 mm.

18. The method of forming an imaging array according to claim 10, wherein a width of an individual driver die from the plurality of driver dies is less than a width of the an individual imaging die from the plurality of imaging dies.

* * * * *